US006794570B2

(12) United States Patent
Chou

(10) Patent No.: US 6,794,570 B2
(45) Date of Patent: Sep. 21, 2004

(54) BUNDLE TWISTED-PAIR CABLE

(75) Inventor: Chih-Hsien Chou, San Jose, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/229,640

(22) Filed: Aug. 27, 2002

(65) Prior Publication Data

US 2004/0040730 A1 Mar. 4, 2004

(51) Int. Cl.[7] ..... H01B 11/02
(52) U.S. Cl. ..... 174/27; 174/32; 174/36; 174/113 R
(58) Field of Search ..... 174/27, 34, 113 R

(56) References Cited

U.S. PATENT DOCUMENTS 5,132,488 A * 7/1992 Tessier et al. ..... 174/34
6,348,651 B1 * 2/2002 Chou et al. ..... 174/27
6,355,876 B1 * 3/2002 Morimoto ..... 174/27
6,452,094 B2 * 9/2002 Donner et al. ..... 174/27

* cited by examiner

*Primary Examiner*—Chau N. Nguyen
(74) *Attorney, Agent, or Firm*—Wei Te Chung

(57) ABSTRACT

A cable includes a plurality of twisted pairs of conductors in a dense matrix form defining columns and rows thereof in a rectangular coordinate system wherein the twisted pairs in the same row have the same twist direction while have opposite twist directions with those in the two neighboring rows aside, and wherein for each row there is a ninety degrees phase shift between every adjacent two pairs and for each column there is a ninety degrees phase shift between every adjacent two pairs.

13 Claims, 5 Drawing Sheets

0 degree 0 degree 45 degrees 90 degrees

BUNDLE TWISTED-PAIR CABLE

BACKGROUND OF THE INVENTION

1. Field of the Invention

The invention relates to the twisted pair cable, and particularly to the cable having a bundle of twisted pairs of conductors.

2. The Related Art

U.S. Pat. No. 6,348,651 with the same applicant and the same assignee, discloses an approach to implement low crosstalk of a flat cable having a plurality of twisted pairs (of conductors) closely side by side arranged one another. The arrangement of those plural twisted pairs is essentially concerned about a two dimensional design. Anyhow, sometimes the conductors of the cable is required to be of a bundle type in some applications. In other words, a three dimensional arrangement among the twisted pairs of conductors is required to implement the low crosstalk. U.S. Pat. No. 6,355,876 ('876 patent) discloses an approach to lower the crosstalk. Anyhow, even though the '876 patent tries to introduce a unique way to replace the traditional random trial-and error method for a better result, differentiation of the pitch among different pairs seems still unsystematic and complicated in manufacturing. The two self-twisted pairs require to be further mutually tangled/interleaved with each other. The varied pairs may cause some non-uniform impedance and propagation delay. The cross cancellation among the twisted pairs requires the common-integer turns, thus taking a longer distance for implementation of such crosstalk cancellation. It questionably fits the high frequency, and still needs another trial-and-error to figure out the lay variations, (referring to different pitches of the different twisted pairs mentioned in column 5, lines 41–57). Additionally, the four twisted pairs as disposed in FIG. 2 of the '876 patent, can be not densely/compactly/evenly arranged with one another, thus taking much space.

An object of the invention is to provide a scientific, systematic, and easy way to lower the crosstalk among the three dimensionally arranged twisted pairs of conductors.

In the aforementioned applicant's previous patent, i.e., U.S. Pat. No. 6,348,651 ('651 patent), it is proved that the twisted pairs with different/opposite twisting directions may each other cancel out the crosstalk noise with around a ninety degrees phase shift where the phase shift is calculated from the offset of the twist starting point or node point between the adjacent pairs, referring to FIG. 2A. Thus, under a controlled/precise manner, the shift angle is expected to be equal to 360*offset(distance)/the twist pitch, as shown in FIG. 1. It is noted that the '651 patent discloses the adjacent two twisted pairs having the opposite twist directions (i.e., clockwise and counterclockwise) because it is derived from FIG. 2 of the '651 patent which is an advanced design relative of FIG. 1 of the '651 patent wherein the two adjacent twisted pairs have the same twist direction (i.e., either clockwise or counterclockwise). Anyhow, the same technology, i.e., the ninety degrees phase shift was considered to be also applicable to the cable shown in FIG. 1 of the '651 patent with the same result (referring to FIG. 2B), except that the radiation/field of the cable in FIG. 2 of the '651 patent may be deemed eliminated due to opposite twist directions between every adjacent two twisted pairs while that of the cable in FIG. 1 of the '651 patent may be accumulated larger due to the same twist direction between every adjacent two twisted pairs without roughly the field cancellation benefit at the far end of the cable.

SUMMARY OF THE INVENTION

The invention is to use both the twisted pairs with the same twist direction and those with the opposite twist directions to form the matrix type arrangement so as to provide a bundle of twisted pairs of conductors in a three dimensional arrangement with one another with the lower crosstalk based on the so-called phase shift theory between the adjacent two twisted pairs as disclosed in the applicant's earlier U.S. Pat. No. 6,348,651 which is concerned about the two dimensional arrangement.

According to an aspect of the invention, a cable includes a plurality of twisted pairs of conductors in a dense matrix form defining columns and rows thereof in a rectangular coordinate system wherein the twisted pairs in the same row have the same twist direction while have opposite twist directions with those in the two neighboring rows aside, and wherein for each row there is a ninety degrees phase shift between every adjacent two pairs and for each column there is a ninety degrees phase shift between every adjacent two pairs. Therefore, according to the theory introduced in the earlier U.S. Pat. No. 6,348,651, the self-cancellation of crosstalk occurs along each row and column, thus resulting in low crosstalk at the far end of the cable.

Another aspect of the invention is to further reduce the crosstalk not only between every adjacent two twisted pairs along directions of row and columns, but also between every adjacent two twisted pairs, along the diagonal directions, which have opposite twist directions under the same aforementioned theory.

DETAILED DESCRIPTION OF THE PREFERRED EMBODIMENTS

Figure 1:
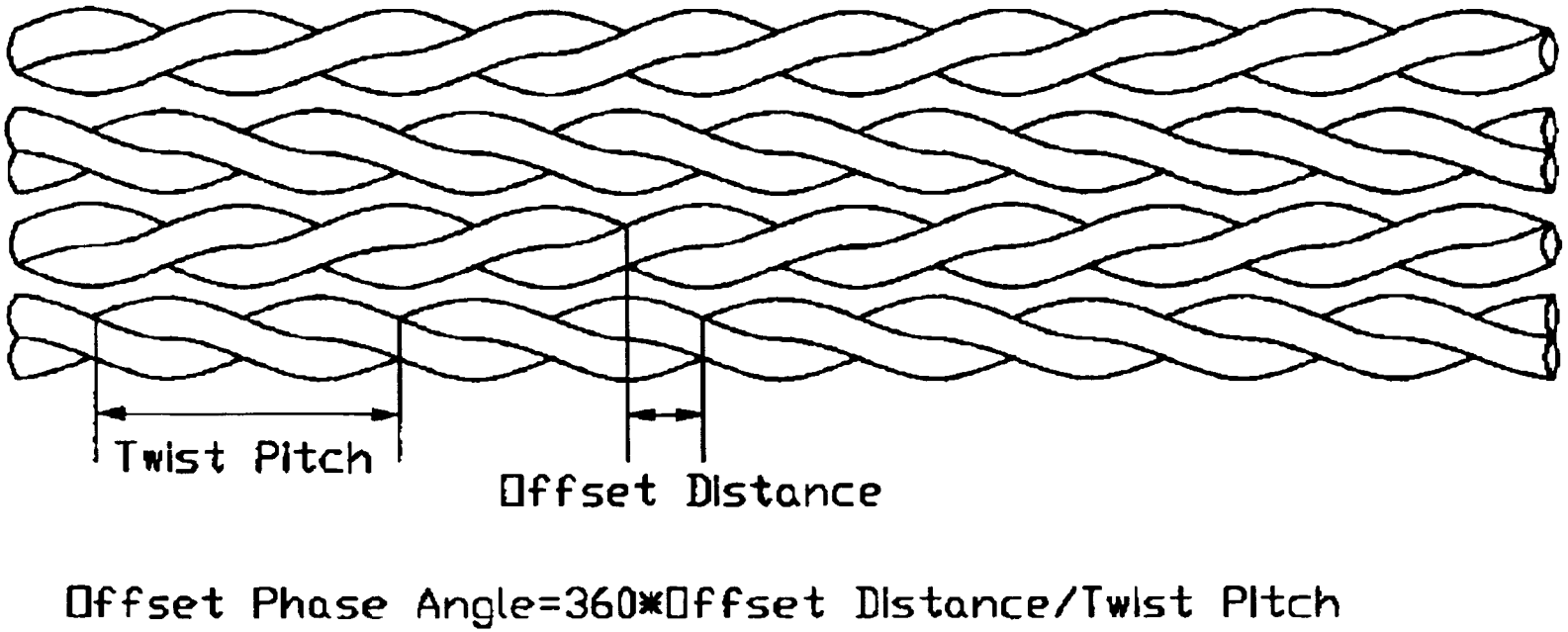
FIG. 1 (PRIOR ART)
FIG. 1 is an illustrative figure reflecting the main figure of the earlier invention disclosed in U.S. Pat. No. 6,348,651.

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. Attention is directed to FIGS. 3A–3C and 4A–4B, wherein a cable 1 includes four twist pairs (of conductors) 10, 12, 14 and 16 arranged in a square matrix grid type where the neighboring pairs 10, 12 are in an upper row and the neighboring pairs 14, 16 in the lower row, the neighboring pairs 10, 14 are in the left column and the neighboring pairs 12, 16 are in the right column, and the pairs 10, 16 neighbor each other in one diagonal direction while pairs 12, 14 neighbor each other in other diagonal direction perpendicular to that one diagonal direction.

Figure 2A:
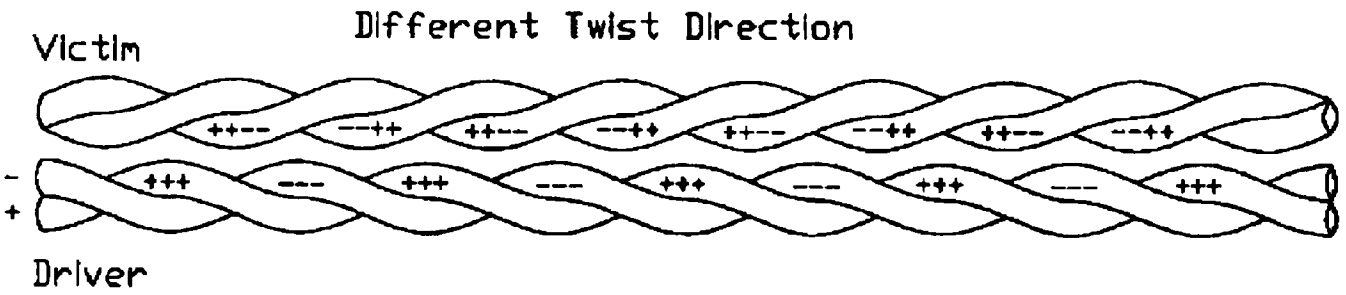
FIG. 2A (PRIOR ART)
FIG. 2A shows the adjacent two twist pairs with the opposite twist directions and the self-cancellation of the crosstalk thereof.
Figure 2B:
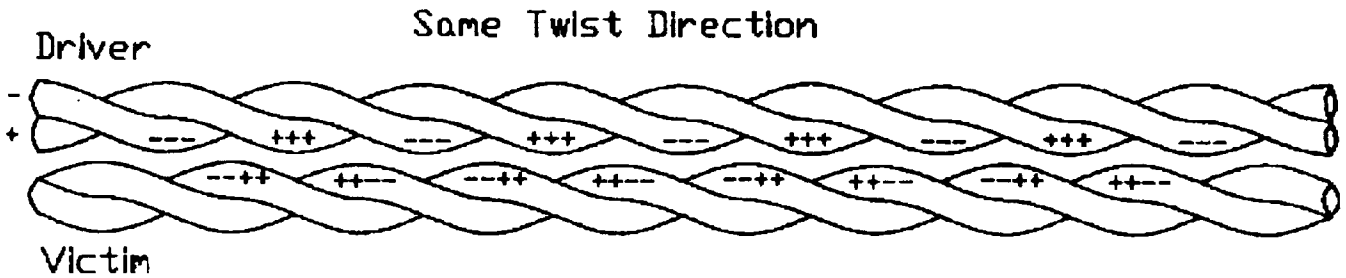
FIG. 2B (PRIOR ART)
FIG. 2B shows the adjacent twist pairs with the same twist direction and the self-cancellation of the crosstalk thereof.

The twisted pairs 10 and 12 have the same twist direction A, i.e., counterclockwise with about ninety degrees phase shift therebetween, and the twisted pairs 14 and 16 have the same twist direction B, i.e., clockwise, which is opposite to direction A, with about ninety degrees phase shift therebetween. According to the theory shown in FIG. 2B, the crosstalk of the adjacent twisted pairs 10, 12 and 14, 16 in each row could be self-cancelled, and similarly the crosstalk of the adjacent twisted pairs 10, 14 and 12, 16 in each column also could be self-cancelled according to theory shown in FIG. 2A.

Anyhow, for each twisted pairs, there are four adjacent pairs in the horizontal/vertical direction as the first level neighbors providing greater crosstalk impact thereto, while there are other four adjacent pairs in diagonal directions as the second level neighbors providing less crosstalk impact thereto. In the invention, the crosstalk between the adjacent two twisted pairs, e.g., that of pairs 10/16 or 12/14 in the diagonal direction is also self-cancelled with the following reasons.

Figure 4B:
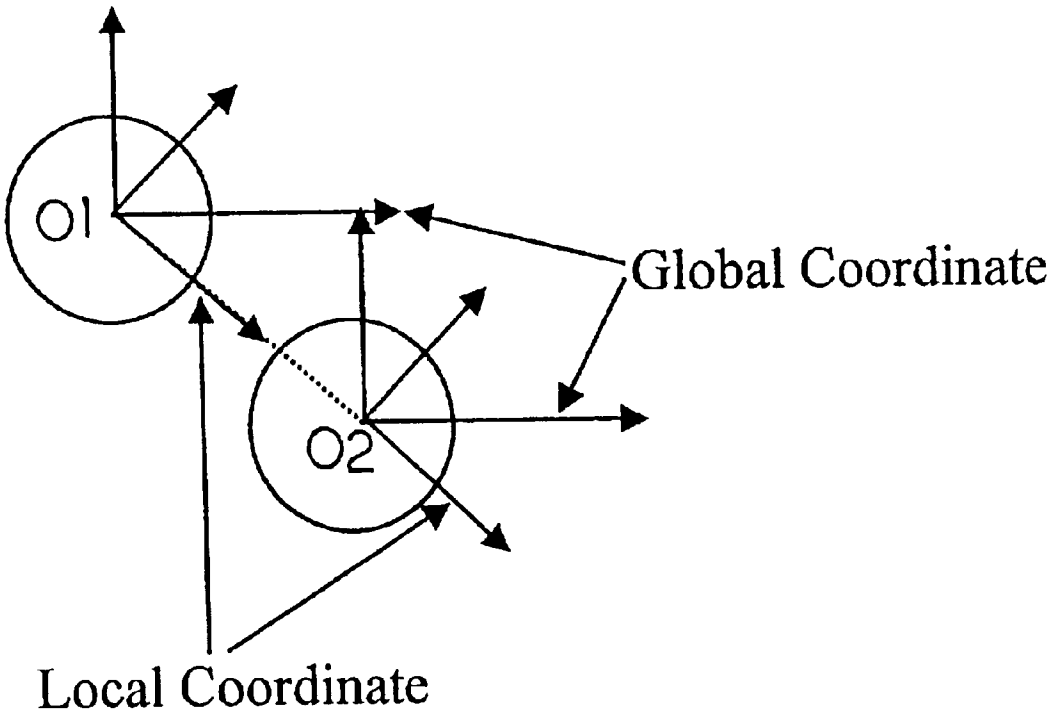
FIG. 4B shows the definition of the so-called local coordinate system used in the invention, which is defined between two diagonally adjacent pairs.
Figure 4A:
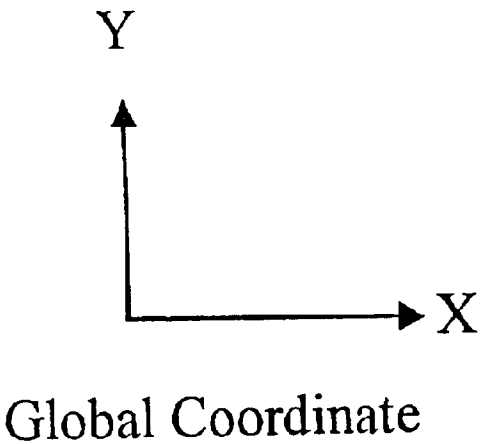
FIG. 4A shows the definition of the so-called global coordinate system used in the invention.
Figure 5A:
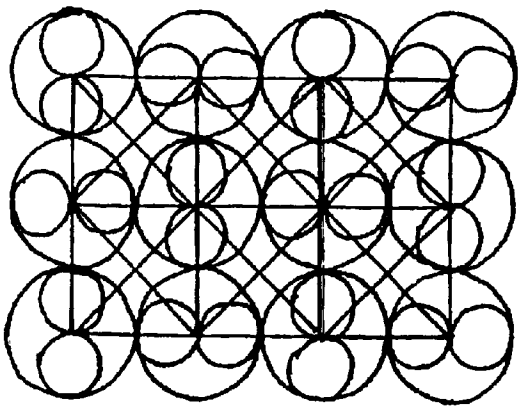
FIG. 5A shows the twisted pairs of a huge matrix grid meaner taken in a first vertical cross-section.
Figure 5B:
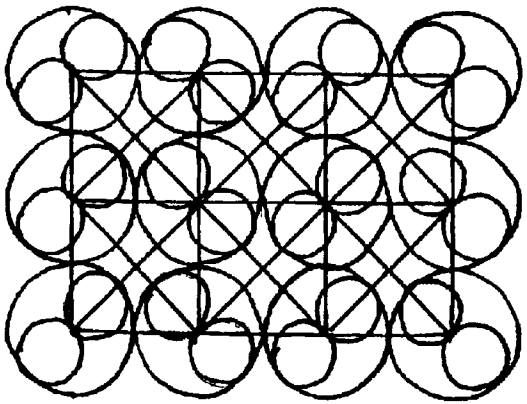
FIG. 5B shows the twisted pairs of FIG. 5A taken in a second vertical cross-section each of the twist pairs is self-twisted about forth-five degrees relative to what in FIG. 5A.
Figure 5C:
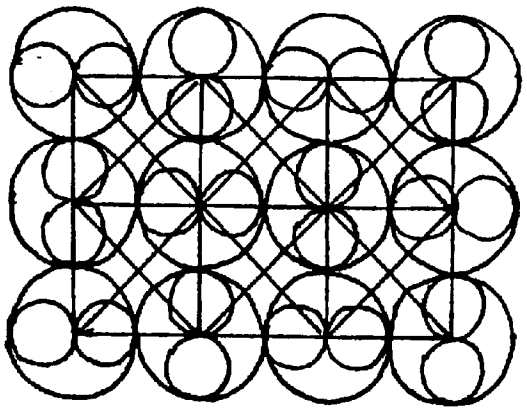
FIG. 5C shows the twisted pairs of FIG. 5A taken in a second vertical cross-section each of the twist pairs is self-twisted about ninety degrees relative to what in FIG. 5A.

Referring to FIGS. 4A and 4B, the phase shift angle as defined in the earlier patent, essentially refers to the local angle of the so-called local coordinate system where the zero degree line is defined by the specific line connected between two individual twist centers O1, O2 of the adjacent two twisted pairs. In the earlier patent, because all the twisted pairs are located in the same plane, the local coordinate systems for all the twisted pairs are the same, and in compliance with the so-called global coordinate system defined in the three dimensional space.

Anyhow, in the instant invention, the twisted pairs change from two dimensional arrangement to three dimensional arrangement. Thus, the so-called global coordinate system is involved herewith, which refers to the rectangular coordinate system defined by the matrix grid. It is noted that in paragraph [0021] the mentioned ninety degrees phase shift between pairs 10/12 or 14/16 in the row and those between pairs 10/14 or 12/16 in the column are referred to this global coordinate system. Because these adjacent pairs are substantially positioned either vertically and horizontally, i.e., columns and rows, in compliance with the vertical and horizontal coordinate axis in the global coordinate system, their local coordinate systems are compliant with the global coordinate system, and thus it is easy to understand how the self-cancellation of the crosstalk works between each of those vertical/horizontal adjacent two pairs. For example, as shown in FIG. 3A, these four twisted pairs 10, 12, 14, 16 are mutually relatively phase-shifted, viewed in vertical and horizontal directions of the global coordinate system, thus clearly indicating the ninety degrees phase shift between the adjacent twisted pairs along the vertical and horizontal directions.

Anyhow, as mentioned in paragraph [0022] the cancellation of the crosstalk is implemented. As shown in FIG. 3B, it is clear that the twist pairs 10 and 16 have the ninety degrees phase shift because in that specific cross-sectional view, along the zero degree line defined in the local coordinate system thereof, the pairs 10, 16 are substantially perpendicular to each other. It is proven these two pairs 10 and 16 are ninety degrees phase-shifted, and accordingly the self-cancellation of the crosstalk occurs therebetween.

Figures 3A, 3B, 3C:
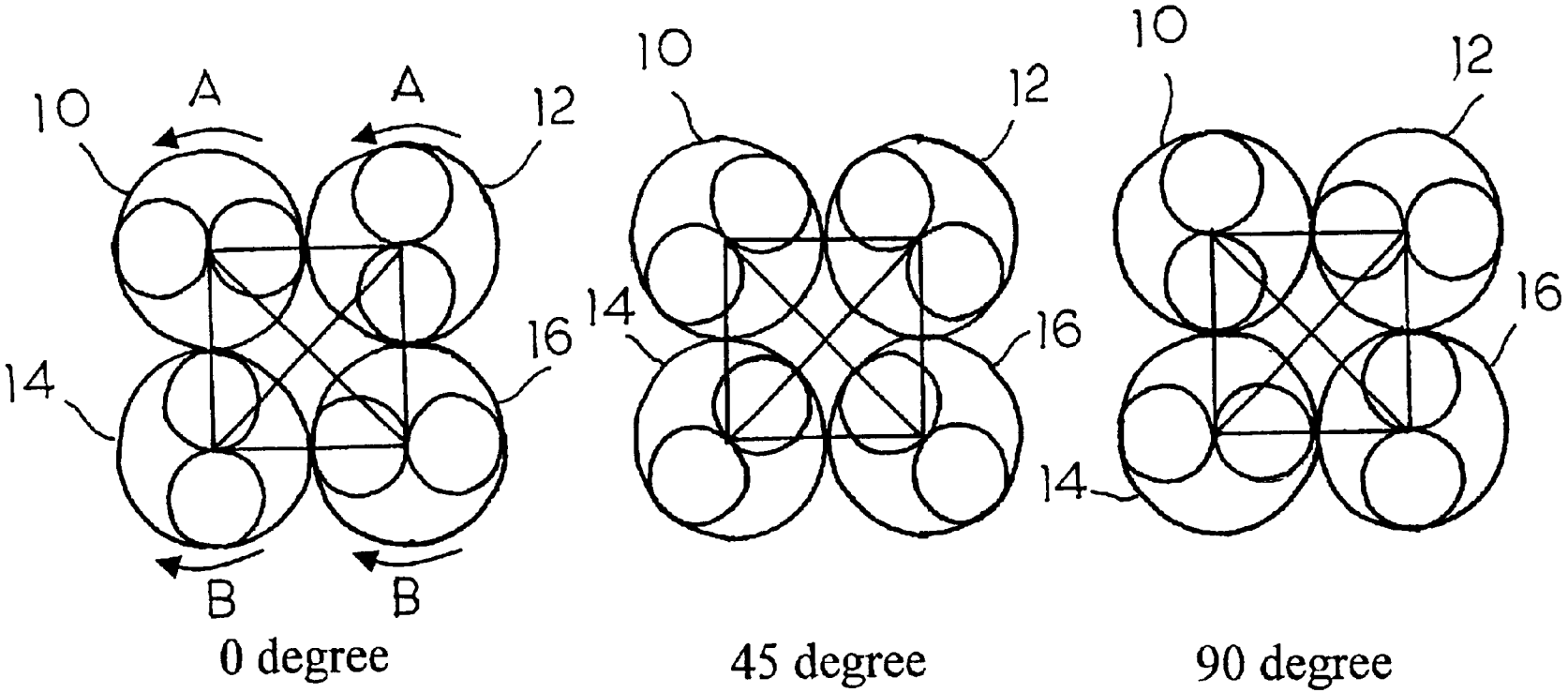
FIG. 3A shows the four twisted pairs arranged in a square matrix grid manner taken in a first vertical cross-section.
FIG. 3B shows the four twisted pairs of FIG. 3A taken in a second vertical cross-section where each of the twisted pairs is self-twisted about forty-five degrees relative to that in FIG. 3A.
FIG. 3C shows the four twisted pairs of FIG. 3A taken in a third vertical section where each of the twisted pairs is self-twisted about ninety degrees relative to that in FIG. 3A.

It should be noted the phase shift relation among the twisted pairs keeps the same throughout all FIGS. 3A–3C. For example, in this embodiment the global phase shift angle of the twisted pairs 10, 12, 14 and 16 are 0 degree, 90 degrees, 90 degrees and 0 degree. Anyhow because of illustration limitations of the plane view, it is easy to see how the adjacent two twisted pairs in either the vertical or horizontal direction, i.e., column or row, have the 90 degrees phase shift therebetween in both FIGS. 3A and 3C, and to see how the adjacent two twisted pairs in diagonal directions have the 90 degrees phase shift therebetween in FIG. 3B.

It is noted even though the twisted pairs 10/16 (or 12/14) have no the "global" phase shift angle, i.e., 0 degrees vs. 0 degrees (or 90 degrees vs. 90 degrees) in the global coordinate system, those pairs 10/16 (or 12/14) have the "local" phase shift angle, i.e., 90 degrees, in the local coordinate system defined by the two twist centers of their own. It is because the these two twisted pairs are structurally disposed relative to each other in a diagonal direction in the global coordinate system and the no phase shift angle in the global coordinate system is exactly the ninety degrees phase shift in their local coordinate system defined by themselves. Analogously, this is like a line obliquely extending above the X-Y plane, being essentially unlike another line extending exactly on the X-Y plane, even though both of them may share the same projected line on the X-Y plane.

Therefore, it is proved that for each twisted pairs, the crosstalk induced by all the surrounding adjacent twisted pairs are self-canceled thereof. The low crosstalk is obtained. FIS. 5A–5C show another embodiment of the invention by following the same principle of the first embodiment shown in FIGS. 3A–3C wherein the twist pairs in the same row have the same twist direction while having the opposite twist directions in the adjacent two rows, i.e., the twisted pairs in the same column being arranged in a staggered manner for two opposite twist directions. Additionally, every adjacent two twisted pairs along columns or rows have the ninety degree phase shift from both the global coordinate system viewpoint and the local coordinate system viewpoint, while every adjacent two twisted pairs in diagonal directions, i.e., have the ninety degree phase shift in the local coordinate system while 0 degree (180 degrees) phase shift in the global coordinate system. Clearly and understandably, as mentioned in the first embodiment, to each twisted pair, the crosstalk induced by all the surrounding neighboring twisted pairs are systematically and quickly self-cancelled within each pitch of the twisted pair.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims. For example, the row and column are only mentioned for distinguishing the relative positions in the space, not for limiting the specific directions, thus being interchangable. It is contemplated that even though the instant application discloses only the square/rectangular matrix type arrangement for the twisted pairs, other types such as the hexagonal type may be applied in the same theory, i.e., forming phase shift angle between the two adjacent twisted pair relative to the local coordinate system formed therebetween, as disclosed in a provisional application filed on Aug. 26, 2002.

Therefore, person of ordinary skill in this field are to understand that all such equivalent structures are to be included in the scope of the following claims.

I claim:

1. A cable comprising:

a plurality of twisted pairs densely arranged in a matrix grid manner defining rows and columns, the twisted pairs of the same row having the same twist direction;

the twisted pairs of the same column having opposite twist directions arranged staggered with each other;

every adjacent two twisted pairs in directions of either said rows or said columns, or both, having a phase shift angle with each other in a global coordinate system.

2. The cable as described in claim 1, wherein said phase shift angle is 90 degrees.

3. The cable as described in claim 1, wherein every adjacent two twisted pairs in diagonal directions have no phase shift angle with each other in a global coordinate system while having a phase shift angle with each other in a local coordinate system.

4. The cable as described in claim 1, wherein there are two rows and two columns of the twisted pairs.

5. A method of reducing crosstalk of a bunch of twisted pairs of a cable, comprising the steps of:

densely arranging said twisted pairs arranged in columns and rows thereof;

having the twisted pairs in the same row with the same twist direction;

having the twisted pairs in the adjacent two rows with opposite twist directions; and having every adjacent two twisted pairs in the same row or the same column with a phase shift angle therebetween in a local coordinate system defined thereof.

6. The method as described in claim 5, wherein said rows and said columns are arranged perpendicular to each other.

7. The method as described in claim 5, further including a step of having every adjacent two twisted pairs in a diagonal direction with a phase shift angle therebetween in another local coordinate system defined thereof.

8. A cable comprising:

a plurality of twisted pairs densely arranged in a three dimension manner commonly defining a global coordinate system;

every adjacent two twisted pairs defining a local coordinate system wherein a zero angle line is defined by a connection line between two twist centers of said adjacent two twisted pairs; wherein for said every adjacent two twisted pairs, there is a phase shift angle therebetween in the local coordinate system regardless of whether there is a phase shift angle therebetween in the global coordinate system.

9. The cable as described in claim 8, wherein said twisted pairs are arranged in a matrix type.

10. The cable as described in claim 9, wherein the local coordinate system defined by two diagonally adjacent twisted pairs is not compliant with the global coordinate system.

11. A method of reducing a crosstalk in a bunch of twisted pairs in a cable, comprising steps of:

densely arranging the twisted pairs in three dimension directions wherein all the twisted pairs extend in a first of said three dimension directions;

having the twisted pairs stacked in second and third of said three dimension directions; wherein every adjacent two of said twisted pairs along at least one of said second and third directions have a phase shift angle with each other in the local coordinate system defined between said adjacent two twisted pairs.

12. The method as described in claim 11, wherein the twisted pairs arranged in an array along one of said second and third directions, have the same twist direction.

13. The method as described in claim 11, wherein said every adjacent two twisted pairs along one of said second and third directions, have opposite twist directions.

* * * * *